US006754985B1

(12) United States Patent
Lin et al.

(10) Patent No.: US 6,754,985 B1
(45) Date of Patent: Jun. 29, 2004

(54) MARKER SHOE

(76) Inventors: Erik Lin, PMB#1008, 1867 Ygnacio Valley Rd., Walnut Creek, CA (US) 94598-3214; Kuei-Yun Lu, PMB#1008, 1867 Ygnacio Valley Rd., Walnut Creek, CA (US) 94598-3214

( * ) Notice: Subject to any disclaimer, the term of this patent is extended or adjusted under 35 U.S.C. 154(b) by 0 days.

(21) Appl. No.: 10/364,323

(22) Filed: Feb. 12, 2003

(51) Int. Cl.[7] ..... A43B 23/00
(52) U.S. Cl. ..... 36/137; 36/100
(58) Field of Search ..... 36/137, 15, 101, 36/100

(56) References Cited

U.S. PATENT DOCUMENTS 2,473,877 A * 6/1949 Goldstein ..... 36/1
2,607,133 A * 8/1952 Marlowe ..... 36/11.5
3,950,076 A * 4/1976 Carlson ..... 359/519
4,233,760 A * 11/1980 Haynes ..... 36/137
4,377,042 A * 3/1983 Bauer ..... 36/101
4,461,102 A * 7/1984 DeVincentis ..... 36/101
4,497,123 A * 2/1985 Ehrlich ..... 36/32 R
4,712,319 A * 12/1987 Goria ..... 36/137

FOREIGN PATENT DOCUMENTS

EP 534560 * 3/1993
JP 405137604 * 6/1993

* cited by examiner

*Primary Examiner*—Ted Kavanaugh
(74) *Attorney, Agent, or Firm*—Leong C. Lei

(57) ABSTRACT

A marker shoe is fixed to its middle sole by insertion a decoration stripe or a reflective alert stripe; an arc recess being provided on the middle sole and two or more than two insertion holes in given depth being provided at the bottom of the recess to fix the stripe with pile heads to prevent the stripe from falling off and to offer easy replacement among various types of stripes as desired.

1 Claim, 1 Drawing Sheet

MARKER SHOE

BACKGROUND OF THE INVENTION (a) Field of the Invention

The present invention is related to a marker shoe, and more particularly, one having at its middle sole fixed with a decoration stripe or a reflective alert stripe.

(b) Description of the Prior Art

Among the versatile shoes generally available in the market, one type of shoes that are provided with a reflective element for safety reason when their wearer is walking during night hours. A reflective stripe or a small accessory that gives audible and visual effects is provided to where close to the heel of the shoes. The same audible and visual effects are seen also on children shoes to attract the kids to wear them. However, the stripe or accessory has been fastened by adhesion ex-factory. One pair of shoes comes up with only one type of the stripe or accessory. It won't be economic for any one to have as many as pair of shoes simply because of having different stripes or accessories on their shoes. It deprives the wearer of the fun to change the stripe as preferred as frequently at any time.

SUMMARY OF THE INVENTION

The primary purpose of the present invention is to provide a marker shoe that allows its wearer to easily replace with a different decoration stripe or a reflective alert stripe onto both sides of the middle sole at any time as desired. To achieve the purpose, an arc recess is provided each on both sides of the middle sole of the shoe. Multiple holes each in a given depth are provided at the bottom of the recess to respectively receive insertion of pile heads to firmly secure the decoration stripe, reflective alert stripe or any other similar accessories.

With the present invention, the decoration stripe or reflective alert stripe is put into the recess, and pile heads are used to nail the stripe into the holes at the bottom of the recess, thus to be firmly fastened to the middle sole for attractive appearance or alert purpose.

Upon removing or replacing the stripe, simply by pulling the stripe out of the recess and replace it with another type according to the individual preference.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
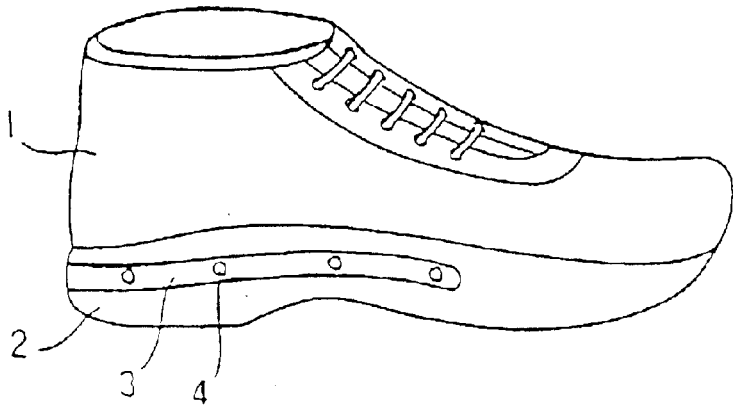
FIG. 1 is a schematic view showing the appearance of a preferred embodiment of the present invention.
Figure 2:
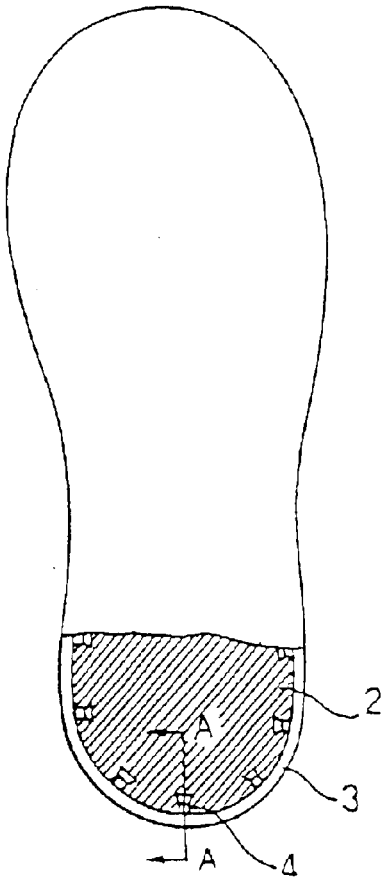
FIG. 2 is a sectional view taken from a local part of an outsole of the preferred embodiment of the present invention.
Figure 3:
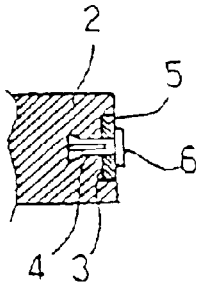
FIG. 3 is a sectional view taken from A—A in FIG. 2.

Referring to FIG. 1, a preferred embodiment of the present invention contains a vamp 1 and an outsole 2. On both sides of the middle sole of the outsole, an arc recess 3 is each provided. Multiple insertion holes 4 each in a given depth are provided at the bottom of the recess 3. Also as illustrated in FIGS. 2 and 3, a decoration strip or an alert stripe 5 (e.g. a fluorescent bar) is inserted in the recess 3 and nailed therein with multiple pile heads 6 into respective insertion hole 4 to be firmly secured to the middle sole. It is also very easy to remove the stripe 5 simply by pulling out those pile heads 6 to release the stripe 5.

The preferred embodiment is essentially having provided the arc recess 3 around the middle sole and having each of the pile head insertion holes 4 at the bottom of the recess 3 to indicate a wedge shape so to even firmly fasten to the pile head 6.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A marker shoe comprising a vamp, an outsole and a reflective strip, wherein an arc recess is formed in said outsole, a plurality of insertion holes being formed in said arc recess and having a wedge shaped bottom, said reflective strip being fitted in said arc recess, a plurality of fasteners extending through said insertion holes to keep said reflective strip in said arc recess.

* * * * *